US007125101B2

(12) United States Patent
Cruz-Uribe et al.

(10) Patent No.: US 7,125,101 B2
(45) Date of Patent: Oct. 24, 2006

(54) PHOTONICALLY ACTIVATED FLUID EJECTOR APPARATUS AND METHODS

(75) Inventors: Antonio S. Cruz-Uribe, Corvallis, OR (US); Mohammad M Samii, La Jolla, CA (US); Scott W Hock, Poway, CA (US); Marshall Field, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 352 days.

(21) Appl. No.: 10/631,391

(22) Filed: Jul. 30, 2003

(65) Prior Publication Data

US 2005/0024433 A1 Feb. 3, 2005

(51) Int. Cl.
*B41J 2/14* (2006.01)

(52) U.S. Cl. ..... 347/51

(58) Field of Classification Search ..... 347/5, 347/51, 54–56, 68

See application file for complete search history.

(56) References Cited

U.S. PATENT DOCUMENTS

| | | | | |
|---|---|---|---|---|
| 5,124,544 | A | 6/1992 | Ohzu | |
| 5,841,448 | A | 11/1998 | Moriyama et al. | |
| 6,799,819 | B1 * | 10/2004 | Samii | 347/3 |
| 2004/0080578 | A1 * | 4/2004 | Dunfield et al. | |
| 2005/0024448 | A1 * | 2/2005 | Cruz-Uribe et al. | |

* cited by examiner

*Primary Examiner*—Shih-Wen Hsieh

(57) ABSTRACT

A fluid ejector head, including a fluid ejector disposed on an ejector support, and a photodetector electrically coupled to the fluid ejector. The fluid ejector head also includes a photon source photonically coupled only to the photodetector. Photons emitted from the photon source interact with the photodetector and generate an activation signal. The activation signal in turn activates the fluid ejector ejecting a fluid away from the fluid ejector.

68 Claims, 12 Drawing Sheets

PHOTONICALLY ACTIVATED FLUID EJECTOR APPARATUS AND METHODS

BACKGROUND

Description of the Art

The micro-manipulation of fluids has tremendous potential in a wide variety of industrially relevant technologies and has seen substantial interest and development over the past several years. For example, in fields such as electronic printing technology using inkjet printers, the ability to accurately, reliably and reproducibly deliver precise quantities of a fluid to a particular location on a receiving medium becomes ever more critical as image quality improves and hence dots per inch increases. In addition, as the number and complexity of fluids manipulated or ejected increases, the susceptibility of the microfluidic device to degradation by components in those fluids also may increase, leading to a reduction in reliability. Further, demand is increasing to reduce the weight and compactness of the fluid ejector head as well as to reduce the cost of the fluid ejector head by utilizing devices that are easier to both assemble and adapt to high volume manufacturing lines. Such demands place additional requirements on both the processes and the materials.

In current use are a wide variety of highly efficient inkjet print heads capable of dispensing ink in a rapid and accurate manner. Commercial products such as computer printers, graphics plotters, facsimile machines, and multi-function devices have been implemented with inkjet technology. However, there is a demand by consumers for ever-increasing improvements in speed and image quality. In addition, consumers increasingly insist on longer lasting fluid ejection cartridges. Fluid ejection cartridges typically include a fluid reservoir that is fluidically coupled to a fluid ejector head. One way to increase the speed of printing is to increase the size of the fluid ejector head by increasing the number of nozzles or fluid ejection elements contained on the fluid ejector head, thereby ejecting fluid over a larger swath of the receiving medium. Each nozzle in a fluid ejector head generally includes a fluid ejection element, and a fluid containing chamber surrounding or adjacent to that fluid ejection element. During operation, the chamber receives fluid from a fluid supply through an inlet channel. The activation of the fluid ejection element ejects the fluid as a droplet through the nozzle and onto the receiving medium. As the number of fluid ejection elements increases, the amount of circuitry necessary to generate more timing and control signals, at a given time, substantially increases. Generally to keep the number of electrical connections to a manageable number, many of the fluid ejector heads are formed on silicon substrates. The utilization of silicon substrates enables the forming of the electronic circuitry and memory cells, necessary to generate the control, timing, and drive signals to activate the fluid ejection elements, on the same substrate on which the fluid ejection elements are formed. Although this provides for a decrease in the number of electrical interconnects, it also greatly increases the cost of each fluid ejector head as the size increases since fewer fluid ejector heads can be formed on each wafer. In addition, as the complexity of these devices increases, the yields decrease which increases the cost.

The ability to develop higher performance fluid ejector heads, that are cheaper smaller and more reliable, will enable the continued growth and advancements in inkjet printing and other micro-fluidic devices. In addition, the ability to optimize fluid ejection systems will open up a wide variety of applications that are currently either impractical or not cost effective.

DESCRIPTION OF THE PREFERRED EMBODIMENTS

Figure 1A:
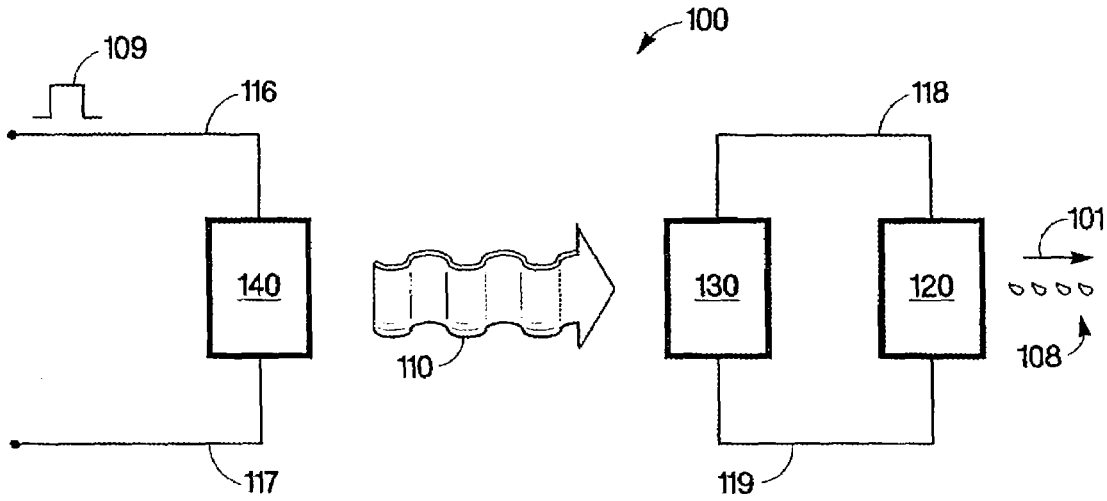
FIG. 1*a* is a schematic view of a fluid ejector head according to an embodiment of the present invention.

Referring to FIG. 1*a*, an embodiment of fluid ejector head 100 of the present invention is shown, in a simplified schematic diagram. In this embodiment, photons 110 emitted from photon source 140 are absorbed by photodetector 130; and generate an activation signal activating fluid ejector 120 to eject fluid 108 from fluid ejector head 100. By providing photon-modulating signal 109 via photon source connection 116 and photon source signal return 117, the light output of photon source 140 may be modulated so that information is contained in the photon beam impinging on photodetector 130. This information is utilized, either directly or indirectly through further signal processing, to actuate fluid ejector 120.

Photon source 140, may be any modulatable photon source of sufficient intensity to generate a signal in a photodetector. In this embodiment, photon source 140 includes any photon source emitting photons in some portion of the electromagnetic spectrum from the ultraviolet region to the infrared region including visible radiation. For example, photon source 140 may be a light emitting diode (LED), a laser (in particular a solid state laser), a lamp, a luminescent source (such as an electroluminescent source utilizing either an ac or dc electric field), to name a few sources. In addition, the photon source may also utilize what is generally referred to as a photonic crystal providing, for example, increased efficiency. In this embodiment, fluid ejector 120 may be any device capable of imparting sufficient energy to the fluid to cause ejection of fluid from a chamber. For example, compressed air actuators, such as utilized in an airbrush, or electro-mechanical actuators or thermal mechanical actuators may be utilized to eject the fluid from the chamber. Photodetector 130 may be any device capable of interacting with photons sufficient to generate a signal distinguishable over the noise and leakage current of the device. For example, photoconductive devices such as a photodiode or phototransistor, or photovoltaic devices such as p-n silicon or selenium cells, or photoemissive devices may all be utilized. The particular photodetector utilized will depend on various parameters such as the wavelength region emitted by the particular photon source utilized, the amount of amplification of the detection signal, and the particular fluid ejection characteristics of the fluid ejector utilized, to name just a few.

It should be noted that the drawings are not true to scale. Further, various elements have not been drawn to scale. Certain dimensions have been exaggerated in relation to other dimensions in order to provide a clearer illustration and understanding of the present invention.

In addition, although some of the embodiments illustrated herein are shown in two dimensional views with various regions having depth and width, it should be clearly understood that these regions are illustrations of only a portion of a device that is actually a three dimensional structure. Accordingly, these regions will have three dimensions, including length, width, and depth, when fabricated on an actual device. Moreover, while the present invention is illustrated by various embodiments, it is not intended that these illustrations be a limitation on the scope or applicability of the present invention. Further it is not intended that the embodiments of the present invention be limited to the physical structures illustrated. These structures are included to demonstrate the utility and application of the present invention to presently preferred embodiments.

Figure 1B:
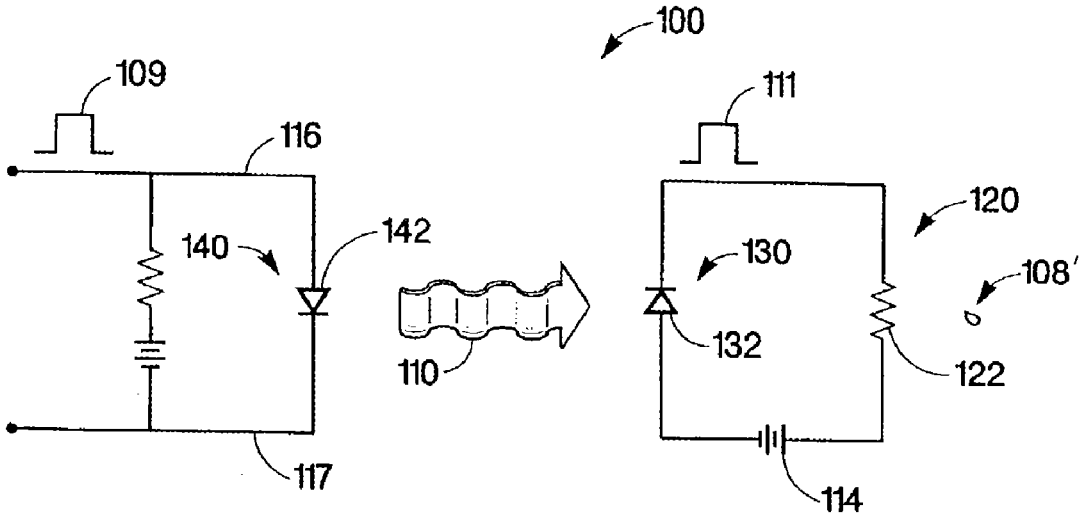
FIG. 1*b* is a schematic view of a fluid ejector head according to an alternate embodiment of the present invention.

Referring to FIG. 1*b*, an alternate embodiment of fluid ejector head 100 is shown, in a simplified schematic diagram. In this embodiment, photon source 140 is LED 142 and photodetector 130 is photodiode 132. Photon modulating signal 109 generates a pulse of photons 110 emitted from LED 142. The emitted photons absorbed by photodiode 132 generate fluid actuator signal 111 by converting the pulse of photons 110 into an electrical signal activating fluid ejector 120. In this embodiment, fluid ejector 120 includes energy converting element 122, which is a thermal resistor. Power supply 114 is electrically coupled between photodiode 132 and fluid energy converting element 122. When a pulse of photons is emitted from LED 142, the electrical conductivity of photodiode 132 is increased to provide a drive current from power supply 114 to heat the thermal resistor. The energy impulse applied across the thermal resistor rapidly heats a component in the fluid above its boiling point causing vaporization of the fluid component resulting in an expanding bubble that ejects fluid drop 108 from a chamber (not shown). In alternate embodiments, other fluid energy converting elements such as piezoelectric, acoustic, mechanical, and electrostatic generators may also be utilized. For example, a piezoelectric element utilizes a voltage pulse to generate a compressive force on the fluid resulting in ejection of a drop of the fluid.

Figure 1C:
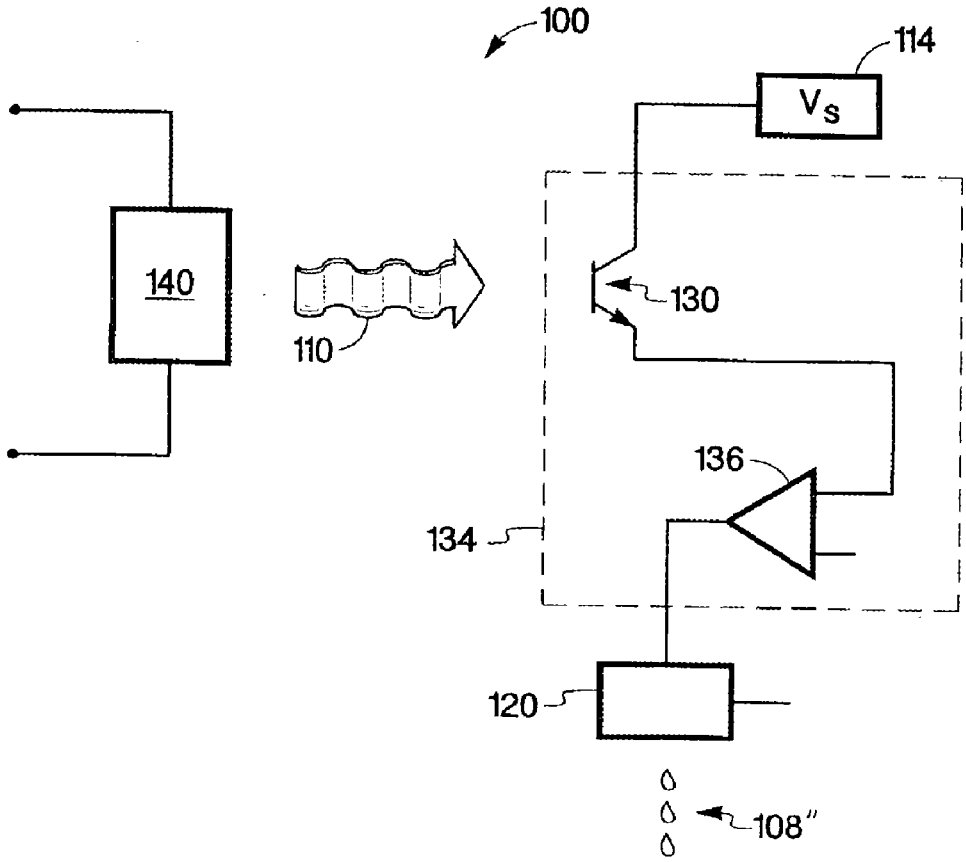
FIG. 1*c* is a schematic view of a fluid ejector head according to an alternate embodiment of the present invention.

Referring to FIG. 1*c*, an alternate embodiment of fluid ejector head 100 is shown, in a simplified schematic diagram. In this embodiment, optical triggering circuit 134 includes photodetector 130 and amplifier 136. Photodetector 130, in this embodiment, is a phototransistor; however, in alternate embodiments, other photodetectors such as photodiodes or photo-Darlingtons may also be utilized. Photodetector 130 is coupled to amplifier 136 and to power supply 114. Photons 110 emitted from photon source 140 generate a relatively low voltage output signal to amplifier 136. Amplifier 136 amplifies the received signal and delivers a corresponding energy pulse to fluid ejector 120 to eject fluid drops 108. In this embodiment, fluid ejector 120 is any device capable of imparting sufficient energy to the fluid to cause ejection of fluid from a chamber.

Figure 1D:
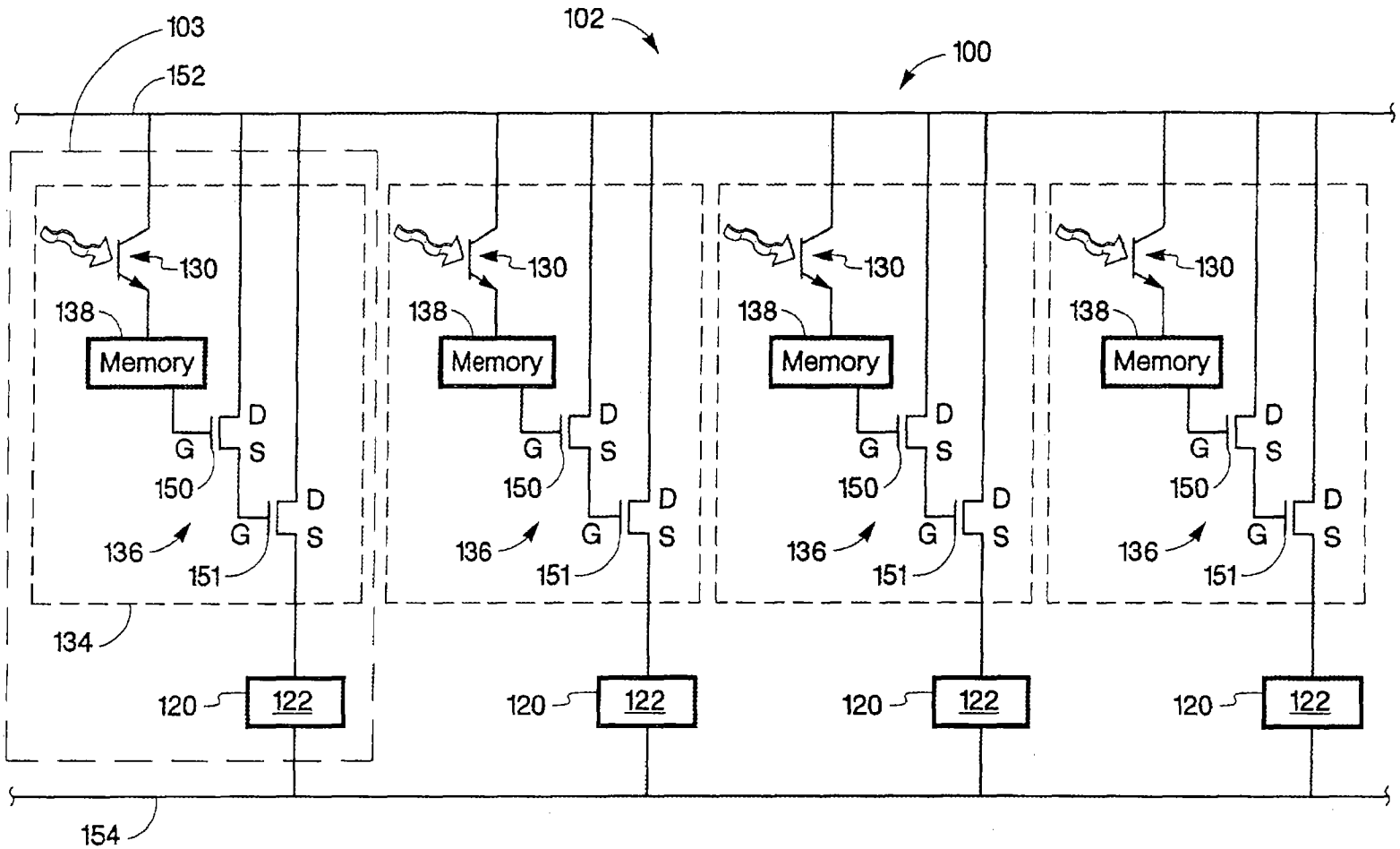
FIG. 1*d* is a schematic view of a fluid ejector array according to an embodiment of the present invention.

Referring to FIG. 1*d*, an exemplary embodiment of fluid ejector head 100 is shown, in a simplified schematic diagram. In this embodiment, fluid ejector head 100 is fluid ejector array 102 having a plurality of array elements 103. Each array element 103 includes a photon source (not shown), optical triggering circuit 134, and fluid ejector 120. In the embodiment shown, fluid ejector 120 includes fluid energy converting element 122 which is a thermal resistor; however, in alternate embodiments any of the fluid ejectors described above may also be utilized. In still other embodiments, various combinations of fluid ejectors may also be used. For example, some of the array elements may include thermal resistors utilized to eject the fluid and other array elements may include piezoelectric transducers to also eject the fluid, all in the same fluid ejector array. Each optical trigger circuit 134 includes voltage level shifter 136, memory device 138 such as a latch, and photodetector 130. In one embodiment, memory device 138 is a toggle or T-type flip-flop that utilizes a second photon pulse to reset the latch. In still other embodiments other types of latches including latches having separate reset terminals may also be utilized. In addition, other Memory devices such as a charge storage capacitor may also be utilized. Voltage level shifter 136 includes transistors 150 and 151.

In one embodiment, transistors 150 and 151 are metal-oxide-semiconductor field effect transistors (MOSFETs); however, in other embodiments, various types of solid state devices may be utilized, such as, junction field effect transistors (JFETs), bipolar junction transistors (BJTs), and silicon controlled rectifiers (SCRs), as well as combinations of these devices. For those embodiments utilizing a non-crystalline semiconductor substrate, such as a glass, ceramic, or polymer substrate, transistors 150 and 151 may be larger than that typically used on crystalline semiconductor substrates such as silicon. The larger size may be used because the electron mobility of amorphous or polycrystalline devices created on a dielectric substrate is, generally, lower than that of conventionally doped crystalline devices. In one embodiment, utilizing a glass substrate transistor 150 has a length of about 2 micrometers to about 8 micrometers, and a width of about 100 micrometers to about 200 micrometers; transistor 151 has a length of about 2 micrometers to about 6 micrometers, and a width of about 600 micrometers to about 10,000 micrometers. In alternate embodiments, other configurations and component dimensions may be utilized for optical triggering circuit 134.

Still referring to FIG. 1*d*, each photodetector 130 of an array element 103 is coupled to voltage supply line 152. The output stage of each photodetector 130 is coupled to an input of memory device 138. An output of memory device 138 is coupled to the gate (G) of transistor 150. The drain (D) of each transistor 150 and 151 is coupled to voltage supply line 152, and the source (S) of each transistor 150 is coupled to the gate of transistor 151. The source of each transistor 151 is coupled to fluid ejector 120. In this embodiment, each thermal resistor 124 is coupled between the source of transistor 151 and the ground bus line 154. When an array element 103 is activated by light from its photon source, photodetector 130 sets memory device 138, which in turn will turn on transistor 150. Transistor 150 in turn, turns on transistor 151, which activates fluid ejector 120 to eject fluid from fluid ejector head 100. In this embodiment, transistor 150 acts as a voltage controlled FET, and serves to control the current of transistor 151.

Figure 2:
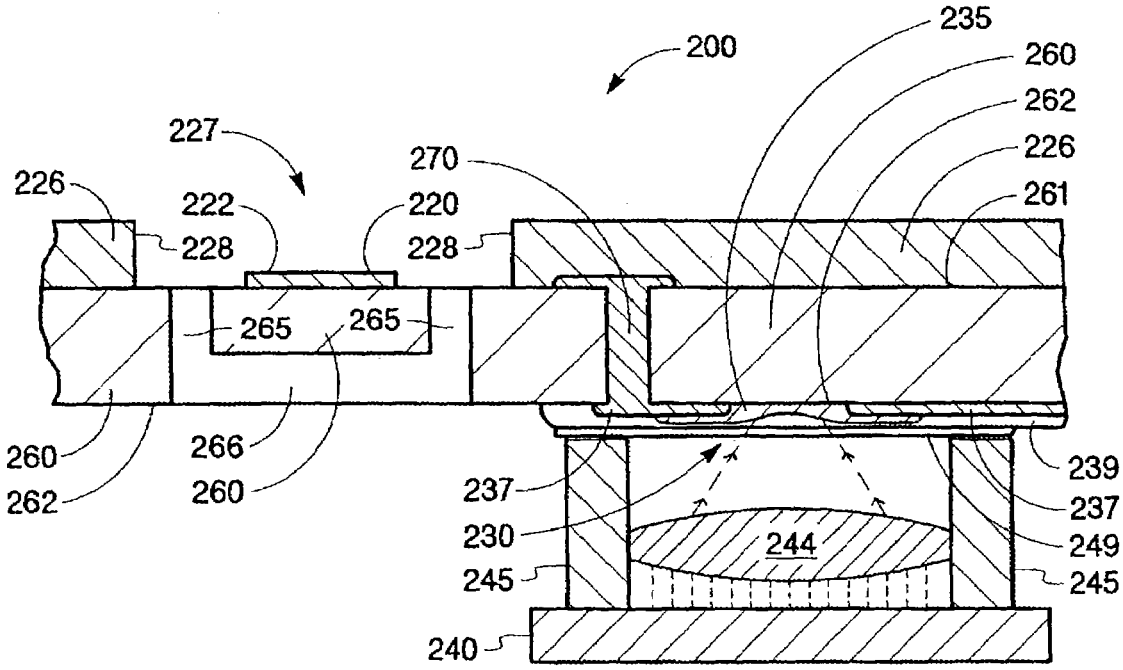
FIG. 2 is a cross-sectional view of a fluid ejector head according to an alternate embodiment of the present invention.

Referring to FIG. 2, a cross-sectional view of an embodiment of fluid ejector head 200 of the present invention is shown. In this embodiment, fluid ejector 220 and photodetector 230 are disposed on substrate 260 with photon source 240 mounted over photodetector 230 and photonically coupled thereto. Substrate 260 has two opposing major surfaces substantially parallel to each other, first major surface 261 and second major surface 262. Fluid ejector 220 including fluid energy converting element 222 is disposed over first major surface 261 of substrate 260. Photodetector 230 is disposed over second major surface 262 with electrical through connect 270 electrically coupling photodetector 230 with fluid ejector 220 via an electrical trace (not shown) that is disposed on substrate 260 either in or out of the plane of the drawing. In this embodiment, substrate 260 is a mono-crystalline silicon substrate having a thickness of about 300–800 micrometers. However, in alternate embodiments, various glasses; ceramics such as aluminum oxide, boron nitride, silicon carbide, and sapphire; semiconductors such as gallium arsenide, indium phosphide, and germanium; and various polymers such as polyimides, and polycarbonates are just a few examples of the materials that may be utilized. Accordingly, the present invention is not intended to be limited to those devices fabricated in silicon semiconductor materials, but will include those devices fabricated in one or more of the available semiconductor materials and technologies known in the art, such as thin-film-transistor (TFT) technology using polysilicon on glass substrates. Further, substrate 260 is not restricted to typical wafer sizes, and may include processing a polymer sheet or film or glass sheet or for example a single crystal sheet or a substrate handled in a different form and size than that of conventional wafers or substrates. The actual substrate material utilized will depend on various system components such as the particular fluid ejector utilized, the particular fluid being ejected, the size and number of fluid ejectors utilized in the particular fluid ejector head, and the environment to which the fluid ejector head will be subjected.

In this embodiment, fluid ejector 220 includes energy converting element 222, which is a thermal resistor. In alternate embodiments, other fluid energy converting elements such as piezoelectric, acoustic, and electrostatic generators may also be utilized. In still other embodiments, fluid ejector 220 may be any device capable of imparting sufficient energy to the fluid to cause ejection of fluid from a chamber, such as compressed air actuators, electromechanical actuators or thermal mechanical actuators. Chamber layer 226 is selectively disposed over first major surface 261 of substrate 260. Sidewalls 228 define or form fluid ejection chamber 227, around energy converting element 222, so that fluid, from fluid distribution channel 266 via fluid inlet channels 265, may accumulate in fluid ejection chamber 227. Activation of energy converting element 222 expels fluid from chamber 227. In alternate embodiments, depending on the particular material utilized for chamber layer 226, an adhesive layer (not shown) may also be utilized to adhere chamber layer 226 to substrate 260. Chamber layer 226, typically, is a photoimagible film that utilizes photolithography equipment to form chamber layer 226 on substrate 222 and then define and develop fluid ejection chamber 227.

Photodetector 230 includes electrical interconnects 237 and photosensing layer 235 formed on second major surface 262. Photodetector 230 is represented as only a single layer in FIG. 2 to simplify the drawing. Those skilled in the art will appreciate that photodetector 230 may be realized as a stack of thin film layers. For example, photodetector 230 may be a photodiode formed by creating doped wells in substrate 260 of opposite polarity to the dopant of substrate 260 (e.g. p-type wafer with n-type wells or n-type wafer with p-type wells). Electrical interconnects then connect with both the substrate and the doped well. Another example is the deposition of polysilicon or epitaxial silicon on a buried oxide with corresponding doped well regions formed in the deposited layer to generate a photodiode. By utilizing various combinations of doped wells and layers, various photodiodes such as p-i-n photodiodes or photodiodes optimized to operate in the avalanche region, as well as phototransistors are just a few examples of structures that may be utilized as photodetector 230. The particular photodetector utilized will depend on various parameters such as the wavelength and intensity of the photon source utilized, the amount of amplification of the detector signal, firing speed of the fluid ejector, as well as the particular environment in which fluid ejector head 200 will be utilized.

Photon source 240 includes lens 244 and lens mount 245, which is mounted essentially over photodetector 230. In this embodiment, lens mount 245 is mounted to planarizing layer 239 utilizing adhesive 249, which is substantially optically transparent in the wavelength region over which photon source 240 emits. In alternate embodiments, other mounting arrangements may also be utilized. For example, lens mount 245 may be extended in a particular direction or directions providing the ability to attach lens mount 245 to substrate 260, with an adhesive, while maintaining photonic coupling of photon source 240 with photodetector 230. Another example utilizes an optically opaque adhesive disposed between lens mount 245 and planarizing layer 239 and not extending into the active region of photodetector 230. In this embodiment, lens 244 may be any glass or plastic lens providing the desired focusing properties for the particular photon source and photodetector utilized. In alternate embodiments, other focusing elements may also be utilized, such as a rod lens with a graded refractive index profile providing a refractive index which decreases in a predetermined manner (e.g. quadratically) with the distance from the lens axis. Nippon Sheet Glass Co sells an example of such a rod lens under the tradename of SELFOC including SELFOC microlens or SELFOC fiber array. In this embodiment, photon source 240 may be any photon source generating sufficient intensity to generate a signal in photodetector 230. For example, photon source 240 may be a light emitting diode (LED), a solid state laser, a lamp, an electroluminescent source.

Figure 3A:
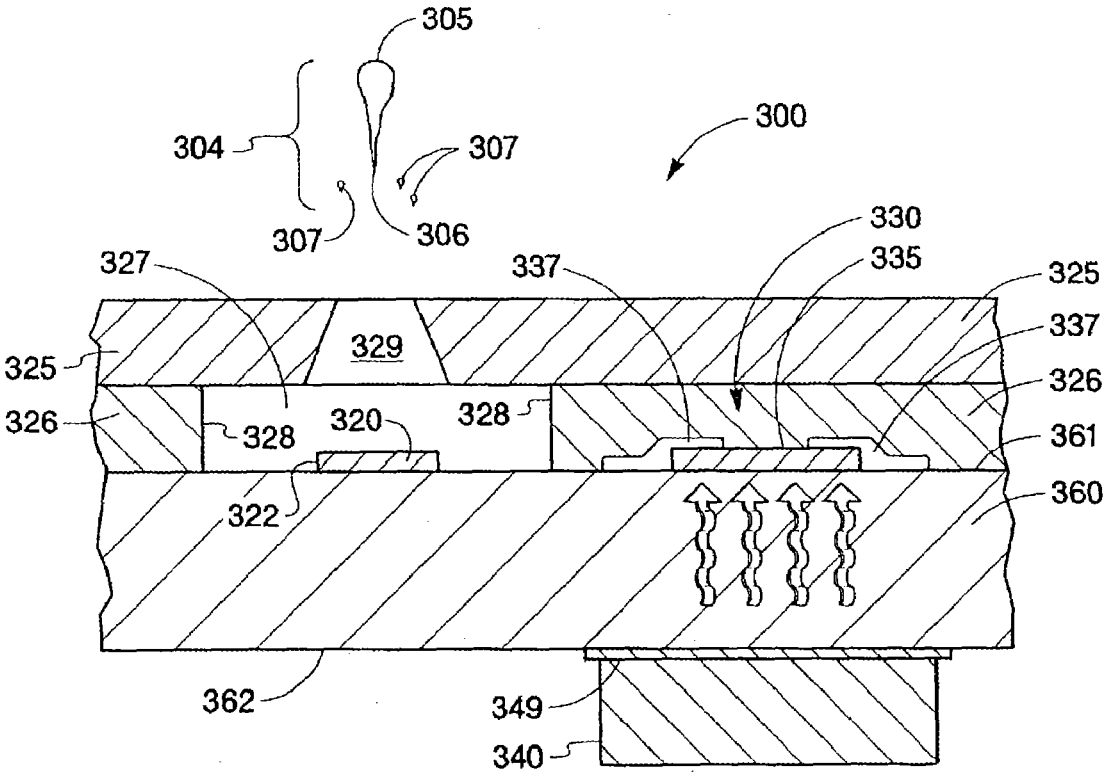
FIG. 3*a* is a cross-sectional view of a fluid ejector head according to an alternate embodiment of the present invention.

Referring to FIG. 3*a*, an alternate embodiment of fluid ejector head 300 of the present invention, is shown in a cross-sectional view. In this embodiment, fluid ejector 320 and photodetector 330 are disposed on essentially optically transparent substrate 360. Photon source 340 is disposed on backside surface 362 of substrate 360, and photonically coupled to photodetector 330 that is disposed on front surface or fluid ejector substrate surface 361 of substrate 360. Fluid ejector 320 includes fluid energy converting element 322. Electrical interconnect 337 electrically couples photodetector 330 to fluid ejector 320 via an electrical trace (not shown) that is disposed on substrate 360 either in or out of the plane of the drawing. In this embodiment, substrate 360 is a glass substrate and may include any of the borosilicate, soda lime or quartz glasses (including crystalline and amorphous). However, in alternate embodiments, materials such as silicon oxide including silicon dioxide or silicon oxynitride, silica mixed with oxides of, for example, potassium, calcium, barium or lead, sapphire, or various polymers such as polycarbonates, polyethylene terephthalate, polystyrene, polyimides, and acrylates including polymethylmethacrylate may also be utilized. In one embodiment substrate 360 has sufficient transmittance in the wavelength region of photons emitted from photon source 340 to provide a signal to noise ratio of at least two to one. Semiconductor materials transmit photons with energies less than the band gap energy of the semiconductor material (i.e. all photons greater than or equal to the band gap energy are absorbed). Thus, in still other embodiments, any substrate sufficiently optically transparent in essentially the wavelength range emitted by photon source 340 providing a detectable signal to noise ratio also may be utilized. For example substrate 360 may be a silicon substrate that transmits light in the infrared region from about 1.3 microns to about 6.7 microns. In such an embodiment, the fluid ejector head would include a photon source emitting in this wavelength region such as solid state diodes or lasers whose active elements include GaAs, InP, $PbS_{(1-x)}Se_x$, $Pb_{(1-x)}Sn_xTe$, or $Pb_{(1-x)}Sn_xSe$.

Chamber layer 326 is selectively disposed over fluid ejector substrate surface 361 of substrate 360. In this embodiment, the fluid inlet channels (not shown) and the fluid distribution manifold (not shown) are formed in chamber layer 326 in and out of the plane of cross-sectional FIG. 3*a*. Side-walls 328 define fluid ejection chamber 327, around energy converting element 322, so that fluid, from the fluid distribution manifold (not shown) via the fluid inlet channels may accumulate in fluid ejection chamber 327 prior to activation of energy converting element 322 and expulsion of fluid through nozzle or orifice 329 when energy converting element 322 is activated. Nozzle or orifice layer 325 is disposed over chamber layer 326 and includes one or more bores or nozzles 329 through which fluid is ejected. In alternate embodiments, depending on the particular materials utilized for chamber layer 326 and nozzle layer 325, an adhesive layer (not shown) may also be utilized to adhere nozzle layer 325 to chamber layer 326. In addition, depending on the particular material utilized for chamber layer 326, an adhesive layer (not shown) may also be utilized to adhere chamber layer 326 to substrate 360. Chamber layer 326, may be a photoimagible film that utilizes photolithographic equipment to form chamber layer 326 on substrate 322 and then define and develop fluid ejection chamber 327. In alternative embodiments fluid ejection chamber 327 may be formed by utilizing other methods such as etching directly into the glass or other substrates, pressure formed, embossed, laser ablated.

Nozzle layer 325 may be formed of metal, polymer, glass, or other suitable material such as ceramic. In one embodiment chamber layer 326 and nozzle layer 325 are formed as a single layer. Such an integrated chamber and nozzle layer structure is commonly referred to as a chamber orifice or chamber nozzle layer. In a second embodiment, nozzle layer 325 is a polyimide film. Examples of commercially available nozzle layer materials include a polyimide film available from E. I. DuPont de Nemours & Co. sold under the trade name "Kapton", a polyimide material available from Ube Industries, LTD (of Japan) sold under the trade name "Upilex." In an alternate embodiment, nozzle layer 325 may be formed from a metal such as a nickel base enclosed by a thin gold, palladium, tantalum, or rhodium layer. In other alternative embodiments, nozzle layer 325 may be formed from polymers such as polyester, polyethylene naphthalate (PEN), epoxy, or polycarbonate.

Fluid ejector 320 includes energy converting element 322, in this embodiment, shown in FIG. 3*a*, and may be any of the fluid energy converting elements described above such as a thermal resistor. In such an embodiment, an electrical energy impulse applied across the thermal resistor rapidly heats at least one component in the fluid above its boiling point causing vaporization of the fluid component resulting in an expanding bubble that ejects fluid drop 304 as shown in FIG. 3*a*. Fluid drop 304 typically includes droplet head 305, drop-tail 306, and satellite-drops 307, which may be characterized as essentially a fluid drop. In such an embodiment, each activation of energy converting element 322 results in the ejection of a precise quantity of fluid in the form of essentially a fluid drop; thus, the number of times the fluid energy converting element is activated controls the number of drops 304 ejected from nozzle 329 (i.e. n activations results in essentially n fluid drops). Thus, fluid ejector head 300 may generate discrete droplets of a fluid, including, for example a solid material dissolved in one or more solvents or suspended or dispersed in the fluid, onto a discrete predetermined location on the surface of a receiving medium. Another example is a solid material that undergoes a phase change first, and is subsequently ejected from a drop generator.

The drop volume of fluid drop 304 may be optimized by adjusting various parameters such as nozzle bore diameter, nozzle layer thickness, chamber dimensions, chamber layer thickness, energy converting element dimensions, and the fluid surface tension to name a few. Thus, the drop volume can be optimized for the particular fluid being ejected as well as the particular application in which fluid ejector head 300 will be utilized. Fluid ejector head 300 described in this embodiment can reproducibly and reliably eject drops in the range of from about 5 femto-liters to about 750 pico-liters depending on the parameters and structures of the fluid ejector head as described above. In this embodiment the term fluid may include any fluid material such as inks, adhesives, lubricants, chemical or biological reagents, as well as fluids containing dissolved or dispersed solids in one or more solvents.

Photodetector 330 includes electrical interconnects 337 and photosensing layer 335 formed on fluid ejector substrate surface 361 of substrate 360. While photodetector 330 is represented as only a single layer in FIG. 3*a* to simplify the drawing, photodetector 330 may be realized as a stack of thin film layers. For example, photodetector 330 may be a photodiode formed by creating a polycrystalline p-type semiconductor layer with doped n-type wells formed in the polycrystalline p-type semiconductor layer. Electrical interconnects 337 connect with both p-type semiconductor layer and the n-type doped well. Another example involves forming a photodiode by creating a polycrystalline n-type semiconductor layer with doped p-type wells formed in the polycrystalline n-type semiconductor layer. Such detectors may be formed from a wide range of semiconductor materials, including for example silicon or germanium. In an alternate embodiment, an amorphous or an epitaxial semiconductor layer or layers may also be utilized. By utilizing various combinations of semiconducting layers and doped regions or wells, various photodiodes such as p-i-n photodiodes or photodiodes optimized to operate in the avalanche region as well as phototransistors are just a few examples of structures that may be utilized as photodetector 330. The particular photodetector utilized will depend on various parameters such as the wavelength and intensity of the photon source utilized, amount of amplification of the detector signal, the firing speed of the fluid ejector, as well as the particular environment in which fluid ejector head 300 will be utilized.

Figure 3B:
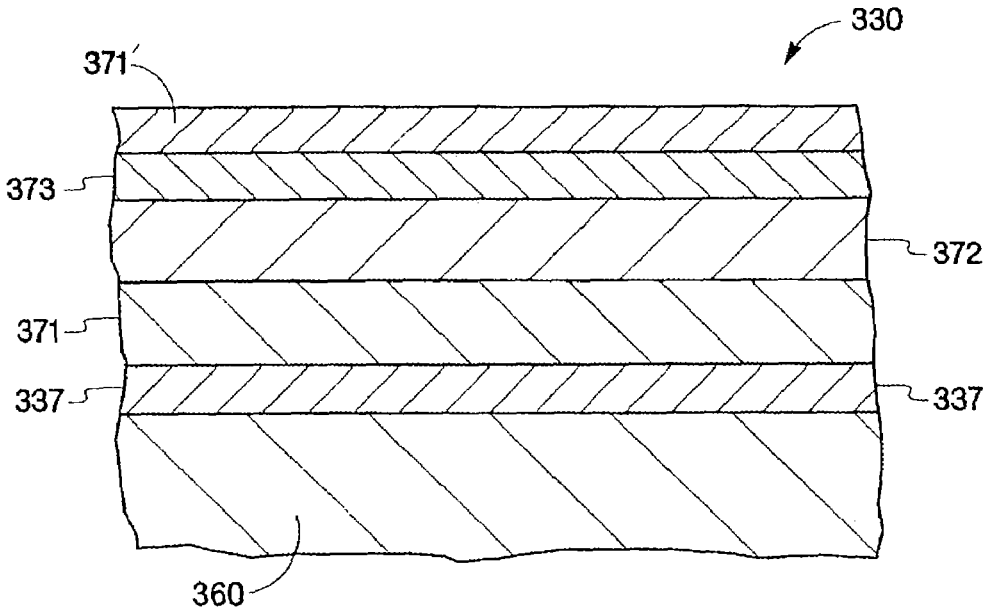
FIG. 3*b* is a cross-sectional view of a photodetector according to an embodiment of the present invention.

A planar structure that may be utilized to form photodetector 330 is shown in a cross-sectional view in FIG. 3*b*. In this embodiment, electrical interconnection 337 is an electrically conductive and essentially optically transparent indium tin oxide layer created or formed on substrate 360. Both the electrical conductivity as well as the optical properties of the indium tin oxide layer may be tuned to optimize the layer for the particular light source and photodetector being utilized. In alternate embodiments, typical metallization schemes such as aluminum or tungsten may also be utilized to provide electrical interconnection 337. In such embodiments, generally, a transparent material such as silicon dioxide will be formed in a desired region or area of photodetector 330 providing an optical path for photons emitted from photon source 340 to interact with photodetector 330. A heavily doped $p^+$-type polysilicon layer 371 is formed over the indium tin oxide layer followed by creation or formation of n-type doped polysilicon layer 372. Heavily doped $n^+$-type polysilicon layer 373 is formed over doped polysilicon layer 372. Aluminum, tungsten or other appropriate metal is deposited or formed on doped polysilicon layer 372 forming electrical interconnect 337'. In an alternative embodiment, the dopant utilized in polysilicon layers 371, 373, and 373 may be opposite of that described above (e.g. $n^+$-type polysilicon layer 371, p-type polysilicon layer 372, and $p^+$-type polysilicon layer 373).

Photon source 340 is mounted to backside surface 362 of substrate 360 utilizing optical adhesive 349, which is substantially optically transparent in the wavelength region over which photon source 340 emits. Photon source 340 is mounted to be essentially in alignment with photodetector 330. As noted above in previously described embodiments, other mounting arrangements may also be utilized. For example, any appropriate adhesive may be disposed in the peripheral region of photon source 340 so that the adhesive does not extend into the active photo-emitting region of photon source 340. In this embodiment, photon source 340 may be any photon source generating sufficient intensity to generate a signal in photodetector 330. For example, photon source 340 may be a light emitting diode (LED), a solid state laser, a lamp, or an electroluminescent source.

Figure 4A:
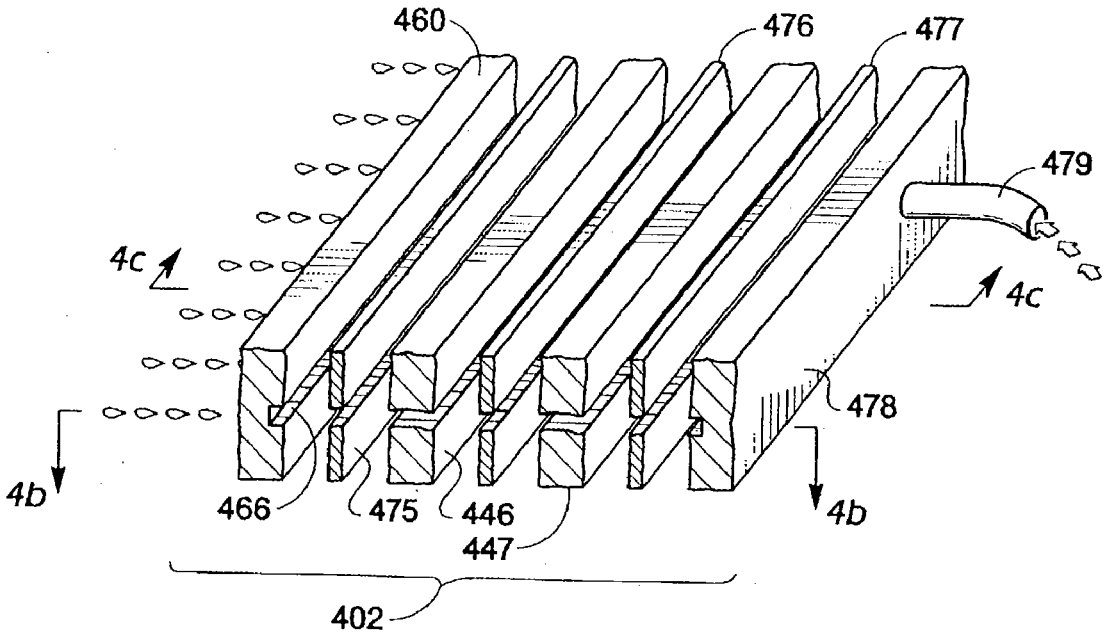
FIG. 4*a* is a perspective view of a fluid ejector array according to an alternate embodiment of the present invention.

A simplified exploded perspective view of an alternate embodiment of the present invention is shown in FIG. 4*a*. In this embodiment, fluid ejector array 402 includes a plurality of fluid ejectors and photodetectors disposed on fluid ejector array substrate 460 photonically coupled, via photon focusing array 446, to photon source array 447. Fluid ejector array also includes fluid manifold 478 that provides fluid distribution to substrate 460 of fluid contained in a reservoir (not shown) coupled via fluid delivery tube 479. The assembly, in this embodiment is assembled utilizing precut epoxy adhesive strips 475, 476, and 477. In this embodiment, fluid ejector array 402 includes a single row of fluid ejectors forming a linear array. In alternate embodiments, fluid ejector array may include an m×n array of fluid ejectors electrically coupled to an m×n array of photodetector elements, that are in turn photonically coupled to an m×n array of photon source elements. Each photon source element is aligned and photonically coupled to a single photodetector element and the m×n array of photon source elements is fixedly mounted to the array of fluid ejectors.

Figure 4B:
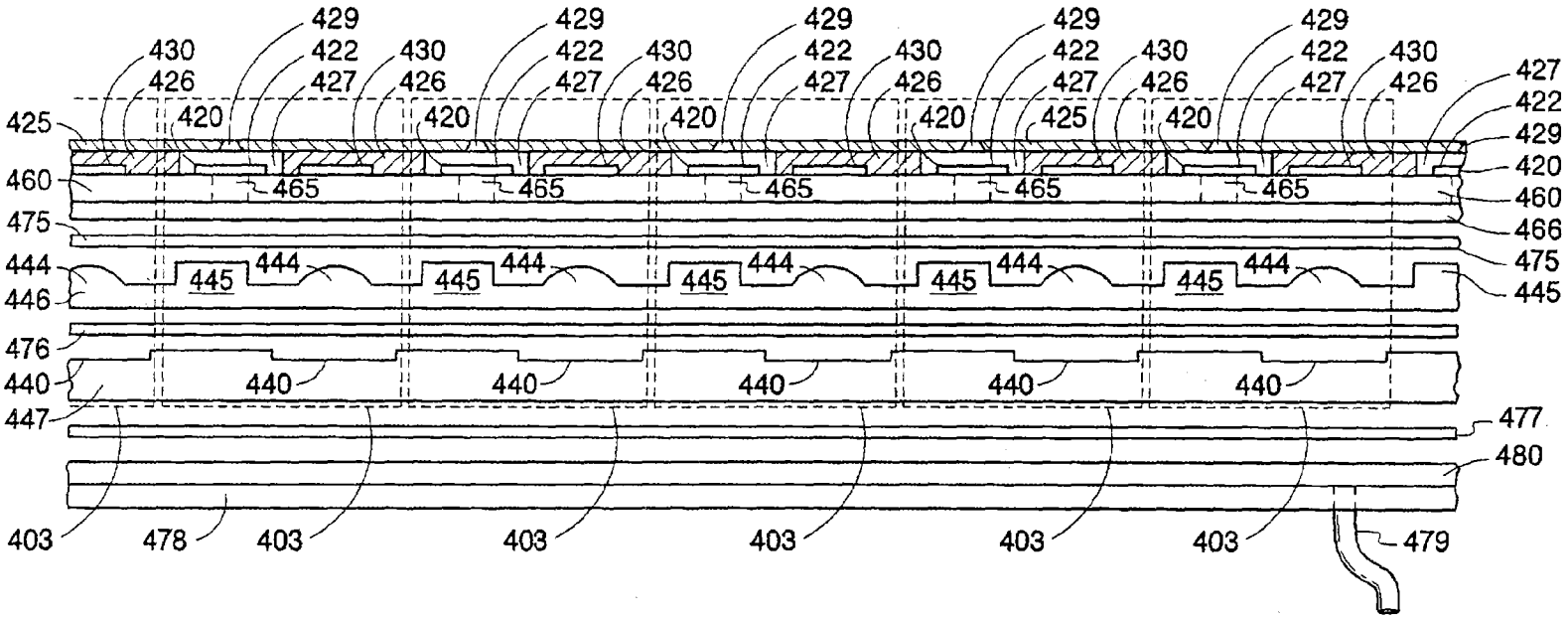
FIG. 4*b* is a cross-sectional view along 4*b*—4*b* showing the fluid ejector array shown in FIG. 4*a;*
Figure 4C:
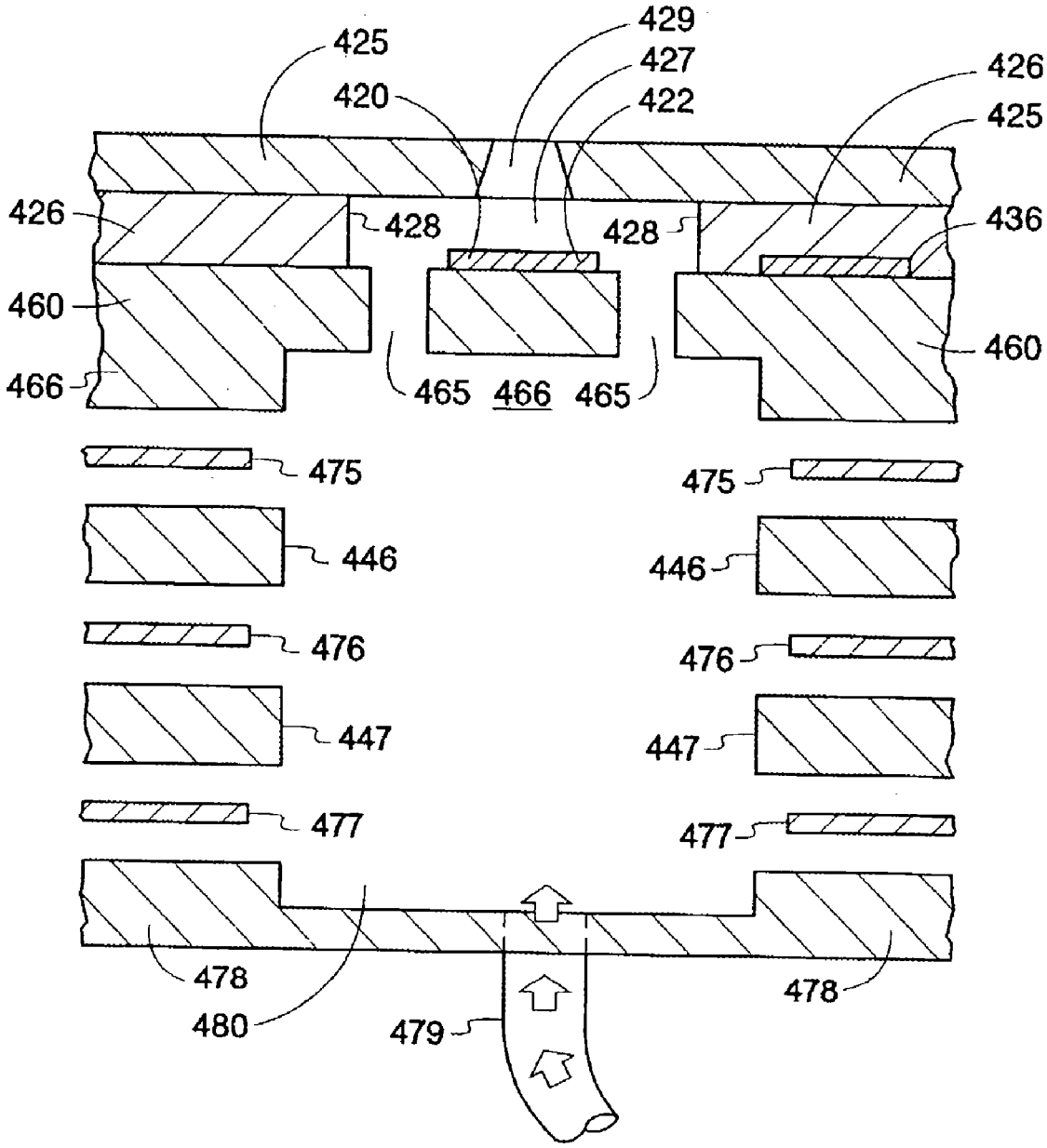
FIG. 4*c* is a cross-sectional view along 4*c*—4*c* showing the fluid ejector array shown in FIG. 4*a;*

Fluid ejector array 402 includes a plurality of array elements 403 as shown in a simplified cross-sectional view in FIG. 4*b*. Each array element 403 includes photon source 440 photonically coupled to photodetector 430 which in turn is electrically coupled to fluid ejector 420. In this embodiment, fluid ejector 420 includes energy converting element 422, which may be any of the fluid energy converting elements described above such, as for example, a thermal resistor. In addition, in alternate embodiments, fluid ejector 420 may be any of the fluid ejectors described above. Substrate 460, in this embodiment is substantially optically transparent with photodetector 430 disposed on the fluid ejector surface of substrate 460. However, in alternate embodiments photodetector 430 may be disposed on the backside or the non fluid ejector surface of substrate 460, wherein non-optically transparent substrates may also be utilized. An example of such a structure is shown in FIG. 2. Chamber layer 426 is selectively disposed over substrate 460 forming fluid ejection chamber 427 defined by side walls 428 as shown in a cross-sectional view taken of fluid ejector head 402 from the perspective of section line 4*c*. In addition, nozzle layer 425, in which nozzles 429 are formed, is disposed over chamber layer 426 as shown in FIGS. 4*b* and 4*c*. In alternate embodiments, nozzle layer may be omitted as shown in the embodiment described in FIG. 2. Fluid from a reservoir (not shown) flows through fluid delivery tube 479 into manifold distribution channel 480 disposed in fluid manifold 478 and through slots formed in photon source array 447 and photon focusing array 446 as well as each of precut epoxy adhesive strips 475, 476, and 477 as shown in a cross sectional view in FIG. 4*c*. The fluid enters fluid distribution channel 466 formed in substrate 460 and flows through fluid inlet channels 465 entering fluid ejection chamber 427. For each array element 403, activation of photon source 440 generates an actuation signal in the corresponding photodetector 430 actuating fluid ejector 420 resulting in ejection of fluid from nozzle 429 of that particular array element. For those embodiments utilizing a voltage level shifter or control circuitry, such as that shown in FIGS. 1*c* and 1*d*, voltage level shifter 436 is shown in FIG. 4*c* as a single layer where both its depiction as only a single layer and its location are only meant to simplify the drawing and to represent such circuitry which may be distributed on substrate 460. Depending on the particular application in which fluid ejector array 403 will be utilized voltage level shifter 436 will include various transistors, logic circuits and other passive devices electrically coupled to photodetector 430 and fluid ejector 420.

Photon focusing array 446, in this embodiment, is a micro-molded lenslet including a micro-molded lens 444 formed in the surface of photon focusing array 446. Micromolded lens mounts 445 are also formed in the surface of photon focusing array 446 and provide a simple method of mounting photon focusing array to substrate 460 while maintaining the proper distance between photon detector 430 and photon source 440 for each array element 403. In alternate embodiments, micro-molded lenses formed on both sides of photon focusing array 446 also may be utilized.

Figure 5:
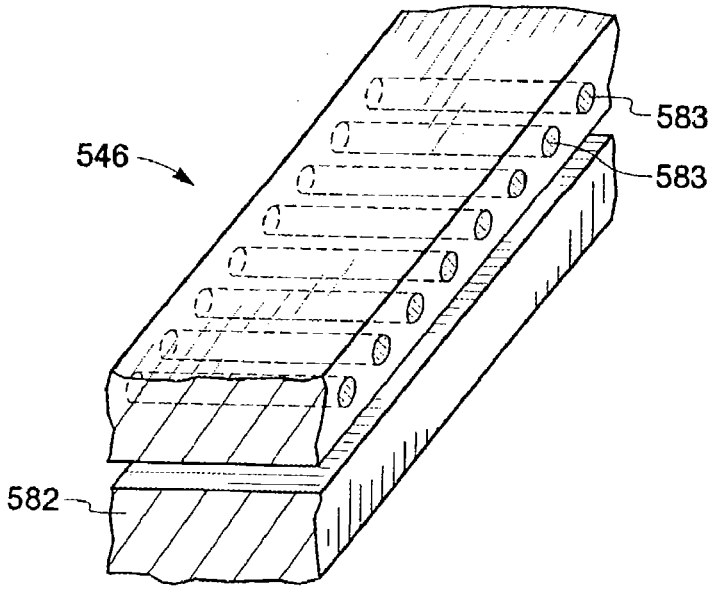
FIG. 5 is an isometric view of photon collimator according to an embodiment of the present invention.

An example of an alternative structure that may be utilized for photon focusing array 446 is shown in an isometric view in FIG. 5. In this example, photon collimator 546 includes body 582 formed from a material having an index of refraction $n_1$ and optical waveguide 583 formed from a material having an index of refraction $n_2$ where $n_2$ is greater than $n_1$. The photon beam is transmitted along the length of waveguide 583 by internal reflection at the step change in the refractive index maintaining the emitted photon beam from photon source 440 essentially in the central core or optical waveguide 583 with minimal loss at the surface of waveguide 583. In alternate embodiments, graded-index structures also may be utilized depending on the particular photon source utilized for fluid ejector array 402. For example, a photon source having a particular multi-mode emission pattern may utilize a graded-index having a parabolic grading of $n_2$.

Figure 6A:
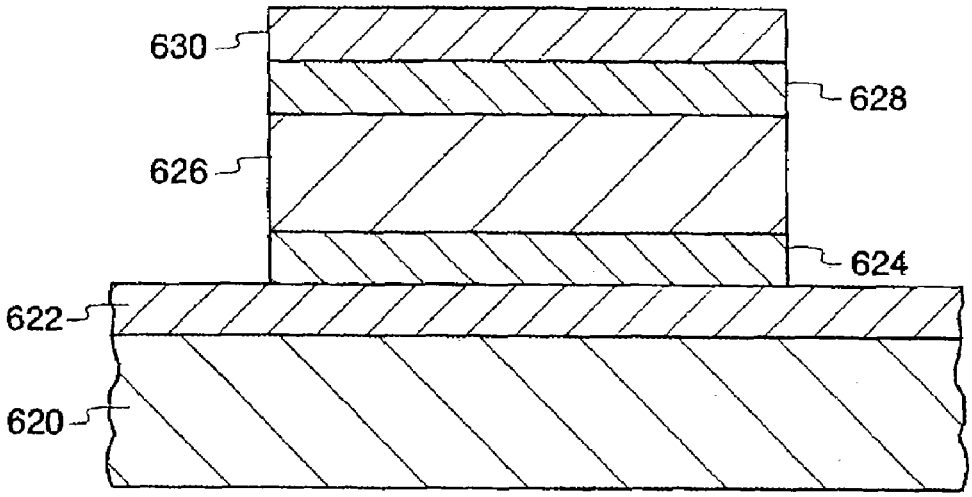
FIG. 6*a* is a simplified cross-sectional view of an individual element of an electroluminescent array according to an embodiment of the present invention.

An individual element of photon source array 447 as well as a photon source for other embodiments of the present invention is shown in a simplified cross-sectional view in FIG. 6*a*. In this embodiment, photon source 640 is an electroluminescent array formed on photon source substrate 620 utilizing electroluminescent layer 626 as the layer in which photons are generated. Photon source array 447 includes any of the electroluminescent sources such as devices emitting light by electrofluorescence or electrophosphorescence or combinations and mixtures of both. Photon source 640 may be driven by either an ac or dc electrical source depending on the particular material or materials used to form electroluminescent layer 622. First electrode layer 622 is deposited or formed on photon source substrate 620. In this embodiment, light is emitted through first electrode layer 622 and substrate 620. Substrate 620 is any material, which is substantially optically transparent in the wavelength region over which electroluminescent layer 626 emits. For example, substrate 620 may be formed from any of the various glasses such as borosilicate, soda lime or quartz glasses (including crystalline and amorphous), or various polymers such as polycarbonates, polyesters such as polyethylene terephthalate, polystyrene, and polyacrylates such as polymethylmethacrylate. First electrode layer 622 may be any electrically conductive material, which is also substantially optically transparent in the wavelength region over which electroluminescent layer 626 emits. For example antimony tin oxide or indium tin oxide deposited or formed on substrate 620 may be utilized. In alternate embodiments, light may be emitted through second electrode layer 630 in which case second electrode would be formed from an appropriate optically transparent material. First dielectric layer 624 is formed on first electrode layer 622, and may be formed from any high dielectric strength material having the appropriate optical transparency for the electroluminescent material being utilized. For example, first dielectric layer 624 may be formed from silicon dioxide, aluminum oxide, polycarbonate, or polyester. Electroluminescent layer 626 is formed over first dielectric layer 624 and second dielectric layer 628 is formed over electroluminescent layer 626 followed by formation of second electrode layer 630 formed over second dielectric layer 628. In an alternate embodiment, electroluminescent layer 626 may be formed directly on first electrode layer 622 eliminating first dielectric layer 624. Second dielectric layer 628 may be formed from any of the high dielectric strength materials utilized in various electronic applications. Second electrode layer may be formed from any of the metal or organic electrical conductors utilized in various electronic applications. For example, dielectric materials include silicon dioxide, silicon nitride, silicon carbide, aluminum oxide, boron nitride, barium titanate, as well as layers formed from combinations of such materials. Electrical conductors include metals, and doped semiconductor materials. A few examples are aluminum, silver, tungsten, gold, cesium, as well as carbon and doped polysilicon or germanium. In addition organic conductors also may be utilized such as polyaniline compounds including camphorsulfonic acid doped polyaniline, polypyrroles, pentacenes, anthracenes, napthacenes, phenanthrenes, pyrenes, thiophene compounds, conductive ink, and similar materials.

Figure 6B:
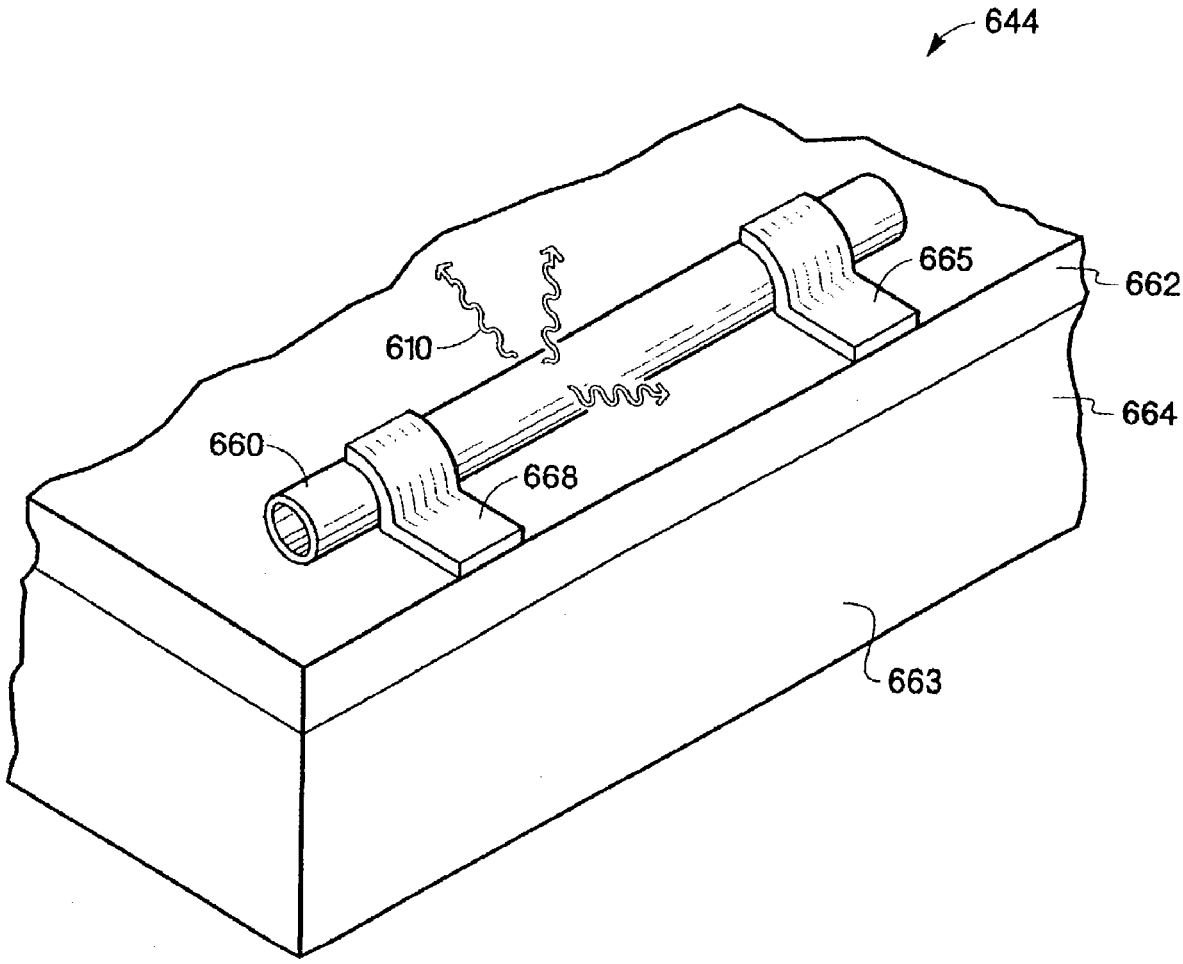
FIG. 6*b* is an isometric cross-sectional view of an individual carbon nanotube photon emitter of a photon source according to an embodiment of the present invention.

Electroluminescent layer 626 may be formed utilizing any of the wide variety of inorganic phosphors, organic materials including polymeric materials, and hybrid layers containing inorganic/organic dispersions. Examples of inorganic phosphors that may be utilized include zinc sulfide, zinc selenide, zinc telluride, manganese sulfide, cadmium telluride, cadmium sulfide, cadmium selenide. Examples of organic materials that may be utilized include aluminum quinolate, 10-azoanthracene (i.e. acridine), 3,6 acridinediamine, carbazole and substituted carbazoles;

Referring to FIG. 6*b*, an alternate embodiment of a photon source is shown in a simplified cross-sectional isometric view. In this embodiment, the photon source includes multiple carbon nanotube photon emitters combined to form a photon source. In alternate embodiments multiple groups of carbon nanotube photon emitters are combined to form an array of photon sources. In FIG. 6*b* one carbon nanotube photon emitter 644, of the multiple emitters contained in the photon source, includes carbon nanotube 660 operated as a three terminal field effect transistor. Carbon nanotube 660 is in contact with silicon dioxide layer 662 formed on p+ silicon substrate 664. Source contact 665 and drain contact 668 are formed over portions of carbon nanotube 660. Carbon nanotube 660 is formed by laser ablation and deposited on silicon dioxide layer 662 via a solution of the carbon nanotubes in for example dichloroethane. Source contact 665 and drain contact 668 are formed from titanium deposited onto portions of carbon nanotube 660 utilizing lithography and lift-off techniques. Source contact 665 and drain contact 668 are about 50 nanometers in thickness. In alternate embodiments, other metals capable of forming metal-nanotube Schottky barriers may also be utilized as well as thicknesses in the range from 10 nanometers to about 100 nanometers. Silicon dioxide layer 662 in this embodiment is about 150 nanometers in thickness; however, in alternate embodiments thicknesses in the range from about 10 nanometers to about 200 nanometers also may be utilized. In this embodiment a silicon dioxide layer (not shown) is also deposited over carbon nanotube 660, as well as source 665 and drain 668 contacts. In alternate embodiments other dielectric materials having the appropriate optical characteristics may also be utilized. In addition, in alternative embodiments, substrate 664 may be formed from any semiconductor material either n+ or p+ such as silicon or gallium arsenide. Substrate 664 forms gate contact 663. The band gap in carbon nanotubes is inversely proportional to the tube diameter. Carbon nanotube 660, in this embodiment has a diameter of about 1.4 nanometers, providing photons in the infrared region of the spectrum. In alternate embodiments, by varying the diameter of the carbon nanotube the wavelength output of carbon nanotube emitter 664 may be controlled.

Figure 7:
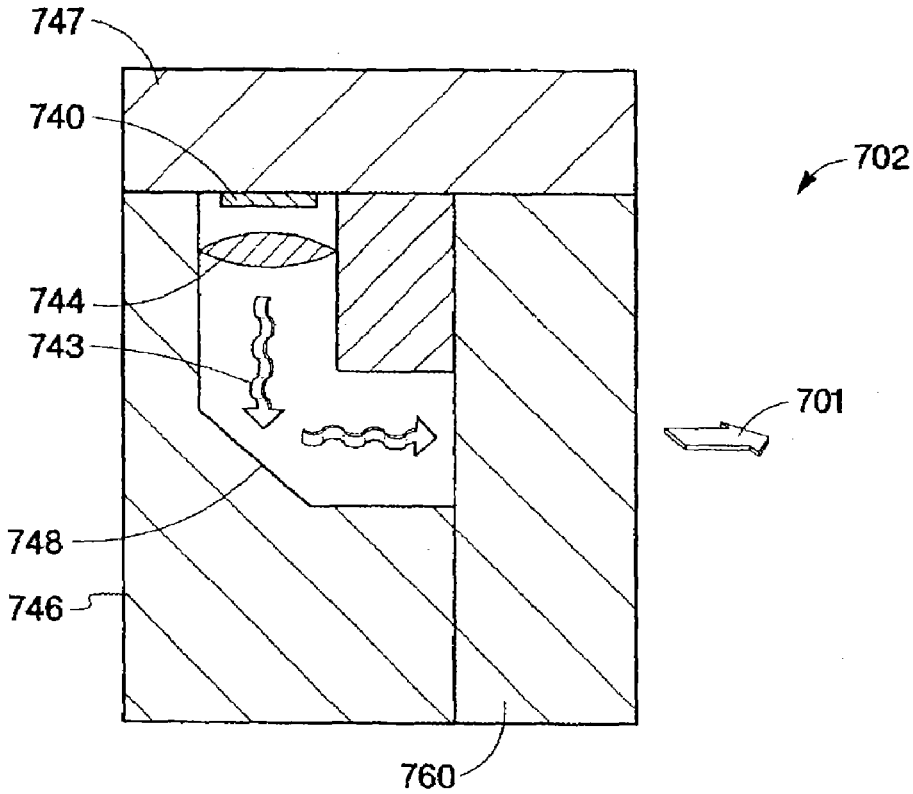
FIG. 7 is a simplified cross-sectional view of a fluid ejector array having the photon source mounted off-axis to the fluid ejection axis according to an embodiment of the present invention.

Referring to FIG. 7, a simplified cross-sectional view of an alternate embodiment of fluid ejector array 702 of the present invention is shown. In this embodiment, photon source array 747 is mounted to fluid ejector array substrate 760 so that the photon beam 743 is off axis to fluid ejection axis 701. In this embodiment, photon beam 743 is essentially ninety degrees from fluid ejection axis 701; however in alternate embodiments, photon beam 743 may be any angle from about zero degrees to about 180 degrees. Light from photon source 740 is focused into photon beam 743 by lens 744 of photon focusing array 746. Photon beam is in turn reflected off of surface mirror 748, also part of photon focusing array 746, onto fluid ejector array substrate 760. In alternate embodiments, other optical devices that change or deviate the direction of the photon beam may also be utilized such as a prism. Fluid ejector array substrate 760 includes a photodetector (not shown) electrically coupled to a fluid ejector (not shown).

Figure 8:
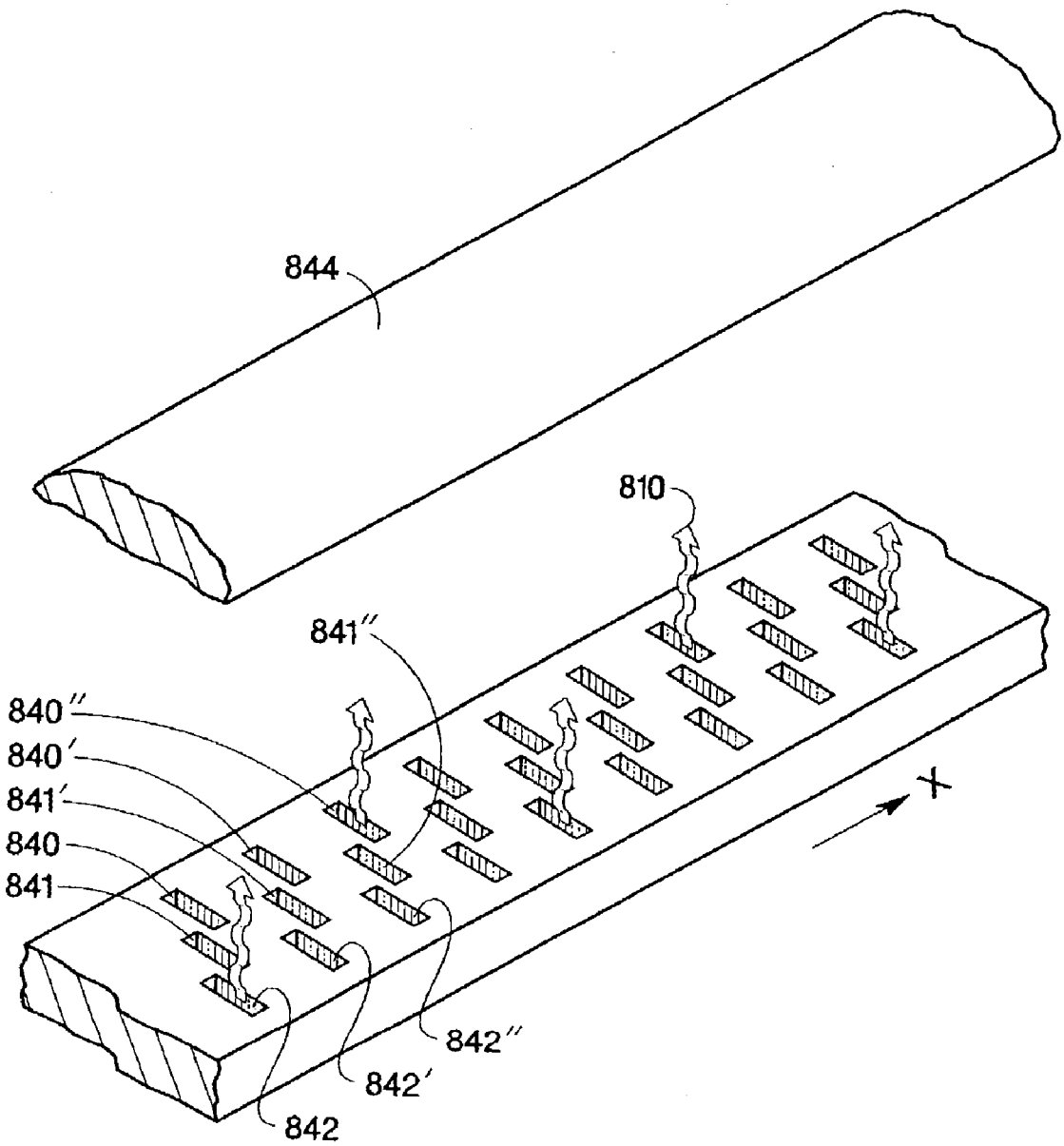
FIG. 8 is a perspective view of a photon source array having a staggered configuration of photon emitters according to an embodiment of the present invention.

Referring to FIG. 8 a perspective view of an alternate embodiment of photon source array 447 is shown. In this embodiment, each photon source 840, 841, and 842 is formed in what is commonly referred to as a staggered configuration. Each photon source 840, 841, and 842 is photonically coupled to its corresponding photodetector through focusing lens 844. Such a configuration provides a higher light source density, and hence more light energy for activation in the x direction while maintaining an increased photon emitting area compared to an array having a straight linear row of photon sources and photodetectors. In particular for printing applications such an array provides for an increase in the dots per inch or print density.

Figure 9:
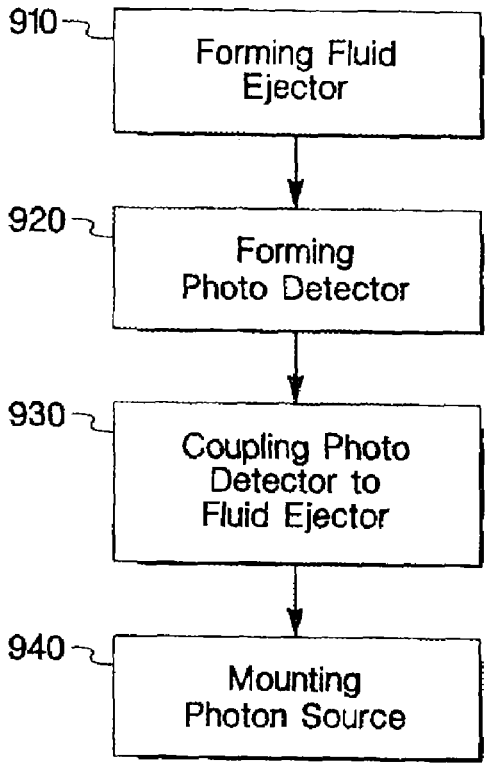
FIG. 9 is a flow diagram of a method of manufacturing a fluid ejector head according to an embodiment of the present invention.

Referring to FIG. 9, a flow diagram of a method of manufacturing a fluid ejector head, according to an embodiment of the present invention, is shown. Fluid ejector forming process 910 is utilized to form the fluid ejector on an ejector support, and depends on the particular transducer being utilized in the fluid ejector head to create the fluid ejector. In one embodiment the ejector support may be a substrate formed from a wide range of materials including semiconductor wafers such as silicon gallium arsenide, indium phosphide, germanium; various glasses, ceramics such as aluminum oxide, boron nitride, silicon carbide, sapphire; and various polymers such as polyimides, polyesters, polyacrylates, and polycarbonates. In other embodiments, ejector support may be a support rod, arm or member utilizing various plastics, metals and ceramic materials. In those embodiments utilizing a support rod, arm or member the fluid ejector may be attached using adhesives or other conventional mechanical fastening devices.

In those embodiments utilizing a fluid ejector that includes a fluid energy converting element, the energy converting element is generally formed on the substrate utilizing conventional semiconductor processing equipment involving various lithography and etching processes. In alternative embodiments, micromolding, electrodeposition, electroless deposition may also be utilized. For example, in those embodiments utilizing thermal resistor elements, a resistor is formed as a tantalum aluminum alloy utilizing conventional semiconductor processing equipment, such as sputter deposition systems for forming the resistor and etching and photolithography systems for defining the location and shape of the resistor layer. In alternate embodiments, resistor alloys such as tungsten silicon nitride, or polysilicon may also be utilized. In other alternative embodiments, fluid drop generators other than thermal resistors, such as piezoelectric transducers, or ultrasonic transducers may also be utilized. For example, in those embodiments utilizing a piezoelectric element a flexible membrane or wall is formed on the substrate and a piezoceramic element, is formed or attached to the non-fluid side of the membrane. In still other embodiments, such as those utilizing compressed air the fluid ejector may be created with a valve in fluid communication with a fluid chamber.

Photodetector forming process 920 utilizes conventional thin film processing equipment to form a photodetector. In those embodiments utilizing an ejector support such as a rod, arm or member the photodetector may be formed directly on the support or attached thereto utilizing adhesives, or other conventional mechanical fastening devices. For those embodiments utilizing a substrate the photodetector may be formed on the substrate utilized to form the fluid ejector or fluid energy converting element. For example, the photodetector may be a photodiode formed by creating doped wells in the substrate of opposite polarity to the dopant of the substrate (e.g. p-type wafer with n-type wells or n-type wafer with p-type wells) if a semiconductor substrate is utilized. Electrical interconnects then connect with both the substrate and the doped well. Another example, is the deposition of polysilicon or epitaxial silicon on a buried oxide with corresponding doped well regions formed in the deposited layer to generate a photodiode. By utilizing various combinations of doped wells and layers, various photodiodes such as p-i-n photodiodes or photodiodes optimized to operate in the avalanche region as well as phototransistors are just a few examples of structures that may be utilized to form the photodetector. The particular photodetector utilized will depend on various parameters such as the wavelength and intensity of the photon source utilized, presence or absence of amplifying devices, firing speed of the fluid ejector, as well as the particular environment in which the fluid ejector head will be utilized.

Coupling process 930 is utilized to electrically couple the photodetector to the fluid ejector or fluid energy converting element depending on the particular embodiment being utilized. For example, for those embodiments utilizing a substrate that is sufficiently optically transparent to the wavelength region emitted from the photon source the photodetector may be formed on the same major surface of the substrate as the fluid ejector. In such embodiments conventional semiconducting equipment is generally utilized to form electrical conductors coupling the photodetector to the fluid ejector. The electrical conductors may be formed from any of the metals such as aluminum including aluminum-copper-silicon alloys, tungsten, copper, gold, palladium, or heavily doped polysilicon. For those embodiments where the substrate does not have sufficient transmittance in the wavelength region emitted from the photon source to provide a useable signal to noise ratio, the photodetector may be formed on the opposing major surface to that utilized to form the fluid ejector. In this case through holes or through vias may be formed in the substrate utilizing dry or wet etching techniques or combinations of both. For example to form the through vias in a silicon substrate a dry etch may be used when vertical or orthogonal sidewalls are desired. However, when sloping sidewalls are desired a wet etch such as tetra methyl ammonium hydroxide (TMAH) may be utilized. In addition, combinations of wet and dry etch may also be utilized when more complex structures are utilized to form the vias. Other processes such as laser ablation, reactive ion etching, ion milling including focused ion beam patterning, may also be utilized to form the through holes depending on the particular substrate material utilized. Micromolding, electroforming, punching, or chemical milling are also examples of techniques that may be utilized depending on the particular substrate material utilized. Sputter deposition, thermal evaporation, electrodeposition, electroless deposition are a few examples of processes that may be utilized to fill the through hole with an electrical conductor. Electrical traces from the through hole or via to the photodetector and fluid ejector may then be formed utilizing processes described above. In addition for those embodiments utilizing an amplifier or control circuitry, such as that shown in FIGS. 1*c* and 1*d*, an active device forming process may be utilized to form various transistors, logic circuits and other passive devices electrically coupled to the photodetector and/or the fluid ejector. The active device forming process may utilize conventional semiconductor processing or flat panel thin film equipment, or combinations of both to form transistors, as well as the other logic devices required for the operation of the fluid ejector head, on the substrate. These transistors and other logic devices typically are formed as a stack of thin film layers on the substrate. The particular structure of the transistors will depend on the particular application in which the fluid ejector is utilized; however, various types of solid-state electronic devices may be utilized, such as, metal oxide field effect transistors (MOSFET), or bipolar junction transistors (BJT). As described earlier, various substrate materials may be utilized. Accordingly, technologies such as thin-film-transistor (TFT) technology using polysilicon or amorphous silicon as well as well as active devices formed utilizing organic semiconducting materials may, also, be utilized.

Photon source mounting process 940 is utilized to align and mount or attach a photon source to the ejector support or the substrate on which the fluid ejector is formed. By aligning and mounting the photon source to the support or substrate, the photon source is photonically coupled to the photodetector in a fixed substantially permanent manner eliminating the utilization of any scanning mechanism. In one embodiment the photon source is aligned and then attached to the substrate via a preformed epoxy adhesive. In alternative embodiments utilizing a photon collimator, a lens, a mirror or some combination thereof, the photon source may be attached utilizing adhesives or other conventional mechanical fastening devices to the photon collimator or other device which in turn is mounted to the support or the substrate.

Depending on the particular embodiment utilized as well as the particular application in which the fluid ejector head may be utilized, the following processes may, also, be used. A chamber layer forming process may be utilized to form the fluid chamber around the fluid ejector. The particular process depends on the particular material chosen to form the chamber layer, or the chamber orifice layer when an integrated chamber layer and nozzle layer is used. The particular material chosen will depend on parameters such as the fluid being ejected, the expected lifetime of the fluid ejector head, the dimensions of the fluid ejection chamber and fluidic feed channels among others. Generally, conventional photoresist and photolithography processing equipment or conventional circuit board processing equipment is utilized. For example, the processes used to form a photoimagible polyimide chamber layer would be spin coating and soft baking. However, forming a chamber layer, from what is generally referred to as a solder mask, would typically utilize either a coating process or a lamination process to adhere the material to the substrate. Other materials such as silicon oxide or silicon nitride may also be formed into a chamber layer, using deposition tools such as plasma enhanced chemical vapor deposition or sputtering.

A side wall definition process may be utilized to form the sidewalls and define the geometrical structure of the fluid ejection chamber. The side wall definition process typically utilizes photolithography tools for patterning. For example, after either a photoimagible polyimide or solder mask has been formed on the substrate, the chamber layer would be exposed through a mask having the desired chamber features. The chamber layer is then taken through a develop process and typically a subsequent final bake process after develop. Other embodiments may also utilize a technique similar to what is commonly referred to as a lost wax process. In this process, typically a lost wax or sacrificial material that can be removed, through, for example, solubility, etching, heat, photochemical reaction, or other appropriate means, is used to form the fluidic chamber and fluidic channel structures as well as the orifice or bore. Typically, a polymeric material is coated over these structures formed by the lost wax material. The lost wax material is removed by one or a combination of the above-mentioned processes leaving a fluidic chamber, fluidic channel and orifice formed in the coated material.

A nozzle or orifice forming process is utilized to form a nozzle layer and form the nozzles or bores in the nozzle layer. The nozzle forming process depends on the particular material chosen to form the nozzle layer. The particular material chosen will depend on parameters such as the fluid being ejected, the expected lifetime of the printhead, the dimensions of the bore, bore shape and bore wall structure among others. Generally, laser ablation may be utilized; however, other techniques such as punching, chemical milling, or micromolding may also be used. The method used to attach the nozzle layer to the chamber layer also depends on the particular materials chosen for the nozzle layer and chamber layer. Generally, the nozzle layer is attached or affixed to the chamber layer using either an adhesive layer sandwiched between the chamber layer and nozzle layer, or by laminating the nozzle layer to the chamber layer with or without an adhesive layer.

As described above, some embodiments may utilize an integrated chamber and nozzle layer structure referred to as a chamber orifice or chamber nozzle layer. This layer will generally use some combination of the processes already described depending on the particular material chosen for the integrated layer. For example, in one embodiment a film typically used for the nozzle layer may have both the nozzles and fluid ejection chamber formed within the layer by such techniques as laser ablation or chemical milling. Such a layer can then be secured to the substrate using an adhesive. In an alternate embodiment a photoimagible epoxy can be disposed on the substrate and, then using conventional photolithographic techniques, the chamber layer and nozzles may be formed, for example, by multiple exposures before the developing cycle. In still another embodiment, as described above, the lost wax process may also be utilized to form an integrated chamber layer and nozzle layer structure.

A fluid inlet channel forming process may be utilized to form fluid inlet channels and fluid distribution channels in the substrate. The fluid inlet channel forming process depends on the particular material utilized for the substrate. For example, to form the fluid inlet channels in a silicon substrate, a dry etch may be used when vertical or orthogonal sidewalls are desired. However, when sloping sidewalls are desired a wet etch such as tetra methyl ammonium hydroxide (TMAH) may be utilized. In addition, combinations of wet and dry etch may also be utilized when more complex structures are utilized to form the fluid inlet channels. Other processes such as laser ablation, reactive ion etching, ion milling including focused ion beam patterning, may also be utilized to form the fluid inlet channels depending on the particular substrate material utilized. Micromolding, electroforming, punching, or chemical milling are also examples of techniques that may be utilized depending on the particular substrate material utilized.

Figure 10:
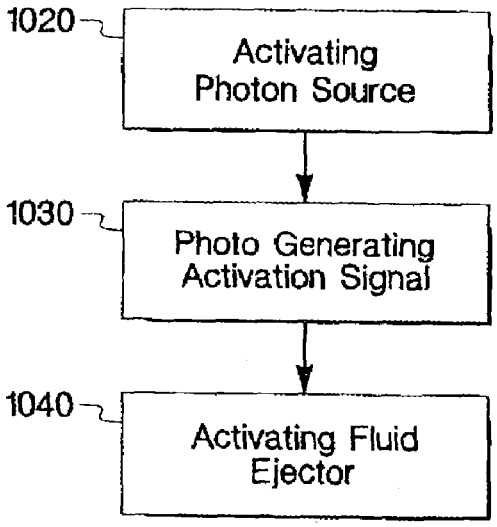
FIG. 10 is a flow diagram of a method of using a fluid ejector head according to an embodiment of the present invention.

Referring to FIG. 10, a flow diagram of a method of using a photon activated fluid ejector head, according to an embodiment of the present invention, is shown. Photon activation process 1020 is utilized to activate a photon source to emit photons. Photon activation process 1020 generally depends on the particular photo-site being activated; however, generally both amplitude modulation and pulse width modulation may be utilized to control the intensity of photons emitted and time over which photons are emitted. Depending on the particular system utilized (i.e. photon source, photodetector, and the fluid ejector), the photon activation process may utilize various pulse schemes from simple square wave pulses to more complex ac or dc wave patterns, depending on, for example, the particular pressure response function of the fluid ejector. Photo-generating activation signal process 1030 is utilized to generate a signal to actuate the fluid ejector. Photons emitted from the photon source and absorbed by the photodetector are converted into an electrical signal thereby generating an activation signal. For those embodiments utilizing a photodiode, the photons absorbed in the active region of the photodiode increase the electrical conductivity of the photodiode generating the activation signal. For those embodiments utilizing a phototransistor coupled to control circuitry, photons absorbed in the base region of the phototransistor increase the electrical conductivity and generate a current that may be coupled to a memory device as shown in FIG. 1*d* or other transistors, amplifiers or logic devices for further amplification and/or modification.

Fluid ejector activating process 1040 is utilized to activate the fluid ejector. Fluid ejector activating process depends on the particular fluid ejector utilized. For example, those embodiments utilizing a photodiode coupled to a thermal resistor the increase in electrical conductivity of the photodiode provides a drive current from a power supply causing an energy impulse to be distributed throughout the thermal resistor rapidly heating a component in the fluid above its boiling point to cause vaporization of the fluid component resulting in an expanding bubble that ejects fluid from the fluid ejector. Another example is those embodiments utilizing a piezoelectric transducer, the photo-generated activation signal applies a voltage pulse across the piezoelectric element to generate a compressive force on the fluid, resulting in ejection of a drop of the fluid.

What is claimed is:

1. A fluid ejector head, comprising:

a fluid ejector disposed on an ejector support;

a photodetector electrically coupled to said fluid ejector; and an electroluminescent photon source photonically coupled to said photodetector, wherein photons emitted from said electroluminescent photon source interact with said photodetector generating an activation signal activating said fluid ejector ejecting a fluid away from said fluid ejector.

2. The fluid ejector head in accordance with claim 1, wherein said ejector support further comprises a substrate, said fluid ejector disposed on said substrate.

3. The fluid ejector head in accordance with claim 2, wherein said fluid ejector further comprises an energy converting element, wherein activation of said energy converting element ejects essentially a drop of said fluid.

4. The fluid ejector head in accordance with claim 3, wherein a volume of said fluid, of essentially said drop, is in a range of from about 5 femto-liters to about 750 pico-liters.

5. The fluid ejector head in accordance with claim 3, wherein said energy converting element further comprises a thermal resistor element.

6. The fluid ejector head in accordance with claim 3, wherein said energy converting element further comprises a piezoelectric element.

7. The fluid ejector head in accordance with claim 2, wherein said electroluminescent photon source emits photons in a predetermined wavelength region and said substrate has sufficient transmittance in said wavelength region to provide a signal to noise ratio of at least two to one.

8. The fluid ejector head in accordance with claim 2, further comprising at least one nozzle disposed over said substrate in fluid communication with said fluid ejector.

9. The fluid ejector head in accordance with claim 8, further comprising:

a chamber layer selectively disposed over said substrate, said chamber layer defining side walls of an ejection chamber; and a nozzle layer disposed over said chamber layer, said nozzle layer having at least one nozzle fluidically coupled to said fluid ejector.

10. The fluid ejector head in accordance with claim 2, further comprising one or more fluid channels fluidically coupled to said fluid ejector.

11. The fluid ejector head in accordance with claim 10, wherein said one or more fluid channels are formed in said substrate.

12. The fluid ejector head in accordance with claim 11 wherein said one or more fluid channels are formed through said substrate.

13. The fluid ejector head in accordance with claim 10, further comprising a fluid manifold fluidically coupled to said one or more fluid channels.

14. The fluid ejector head in accordance with claim 2, wherein said substrate further comprises two opposing major surfaces, a first major surface and a second major surface, wherein said fluid ejector is disposed over said first major surface and said photodetector is disposed over said second major surface, and an electrical through connect disposed in said substrate electrically couples said photodetector and said fluid ejector.

15. The fluid ejector head in accordance with claim 2, wherein said substrate further comprises an inorganic or organic material.

16. The fluid ejector head in accordance with claim 1, further comprising an optical trigger circuit electrically coupled to said photodetector.

17. The fluid ejector head in accordance with claim 16, wherein said optical trigger circuit further comprises at least one amplifying circuit.

18. The fluid ejector head in accordance with claim 16, wherein said optical trigger circuit further comprises:

a memory device electrically coupled to said photodetector; and a voltage level shifter electrically coupled to said memory device and to said fluid ejector.

19. The fluid ejector head in accordance with claim 1, further comprising a focusing element disposed between said electroluminescent photon source and said photodetector.

20. The fluid ejector head in accordance with claim 19, wherein said focusing element further comprises a photon beam deviator, deviating said photons in a predetermined direction.

21. The fluid ejector head in accordance with claim 20, wherein said photon beam deviator further comprises a prism and a lens.

22. The fluid ejector head in accordance with claim 21, wherein said prism and said lens are molded into a unitary piece.

23. The fluid ejector head in accordance with claim 19, wherein said focusing element further comprises a rod lens having a graded refractive index profile.

24. The fluid ejector head in accordance with claim 23, wherein said rod lens further comprises a lens axis, wherein said graded refractive index decreases quadratically from said lens axis.

25. The fluid ejector head in accordance with claim 19, wherein said focusing element further comprises a photon beam collimator having a body including a body material having an index of refraction of n1, said photon beam collimator further includes an optical waveguide including a waveguide material having an index of refraction of n2, wherein said body material forms an interface with said waveguide material, and n2 is greater than n1.

26. The fluid ejector head in accordance with claim 1, wherein said photodetector further comprises a photodiode.

27. The fluid ejector head in accordance with claim 1, wherein said photodetector further comprises a phototransistor.

28. The fluid ejector head in accordance with claim 1, further comprising a charge storage capacitor electrically connected to said photodetector.

29. The fluid ejector head in accordance with claim 1, wherein said electroluminescent photon source emits in a predetermined portion of the electromagnetic spectrum from about the ultraviolet region to about the infrared region.

30. The fluid ejector head in accordance with claim 1, wherein said electroluminescent source further comprises an electroluminescent material.

31. The fluid ejector head in accordance with claim 30, wherein said electroluminescent material further comprises an organic electrofluorescence material or an organic electrophosphoresence material.

32. The fluid ejector head in accordance with claim 30, wherein said electroluminescent material further comprises an inorganic electrofluorescence material or an inorganic electrophosphoresence material.

33. The fluid ejector head in accordance with claim 30, wherein said electroluminescent material is selected from the group consisting of zinc sulfide, zinc selenide, zinc telluride, manganese sulfide, cadmium telluride, cadmium sulfide, cadmium selenide, and mixtures thereof.

34. The fluid ejector head in accordance with claim 30, wherein said electroluminescent material is selected from the group consisting of aluminum quinolate, 10-azoanthracene, 3,6 acridinediamine, carbazole, substituted carbazoles, and mixtures thereof.

35. The fluid ejector head in accordance with claim 1, wherein said electroluminescent source further comprises:

a photon source substrate;

a first electrode layer disposed on said photon source substrate;

an electroluminescent layer disposed over said first electrode layer; and a second electrode layer disposed over said electroluminescent layer.

36. The fluid ejector head in accordance with claim 35, further comprising:

a first dielectric layer disposed between said first electrode layer and said electroluminescent layer; and a second dielectric layer disposed between said electroluminescent layer and said second electrode layer.

37. The fluid ejector head in accordance with claim 1, wherein said fluid ejector further comprises an m×n array of fluid ejectors electrically coupled to an m×n array of photodetector elements, and said electroluminescent photon source further comprises a m×n array of photon source elements, wherein each photon source element is aligned and photonically coupled to a single photodetector element and said m×n array of photon source elements is fixedly mounted to said ejector support.

38. The fluid ejector head in accordance with claim 1, wherein said fluid ejector further comprises an electromechanical or thermomechanical fluid ejector.

39. The fluid ejector head in accordance with claim 1, further comprising a fluid selected from the group consisting of inks, adhesives, lubricants, chemical reagents, biological reagents, and mixtures thereof.

40. A fluid ejector head, comprising:

means for generating an energy impulse to a fluid, disposed on an ejector support;

means for electroluminescently emitting photons mounted to said ejector support; and means for detecting photons photonically coupled to said means for electroluminescently emitting photons, and said means for detecting photons electrically coupled to said means for generating an energy pulse, wherein photons emitted from said means for electroluminescently emitting interact with said means for detecting generating an activation signal activating said means for generating an energy impulse ejecting a fluid away from said means for generating.

41. The fluid ejector head in accordance with claim 40, wherein said means for generating further comprises means for ejecting essentially a drop of said fluid, wherein said drop is in a range from about 5 femto-liters to about 750 pico-liters.

42. The fluid ejector head in accordance with claim 40, further comprising:

means for containing said fluid disposed proximate to said means for generating an energy pulse; and means for fluidically coupling a nozzle to said means for generating an energy impulse.

43. The fluid ejector head in accordance with claim 40, further comprising:

means for storing information electrically coupled to said means for detecting photons; and means for shifting a voltage signal from said means for detecting photons, said means for shifting electrically coupled to said means for generating an energy impulse.

44. The fluid ejector head in accordance with claim 40, further comprising means for focusing photons emitted from said means for electroluminescently emitting photons.

45. The fluid ejector head in accordance with claim 40, further comprising means for deviating photons emitted from said means for electroluminescently emitting photons.

46. A method of manufacturing a fluid ejector head, comprising:

creating a fluid ejector disposed on an ejector support;

electrically coupling a photodetector to said fluid ejector; and photonically coupling an electroluminescent photon source to said fluid ejector; wherein photons emitted from said electroluminescent photon source interact with said photodetector generating an activation signal activating said fluid ejector ejecting a fluid away from said fluid ejector.

47. The method in accordance with claim 46, wherein creating said fluid ejector further comprises creating fluid ejector on a substrate.

48. The method in accordance with claim 47, wherein creating said fluid ejector further comprises creating at least one energy converting element on said substrate, wherein activating said energy converting element ejects essentially a drop of said fluid in a range of from about 5 femto-liters to about 750 pico-liters.

49. The method in accordance with claim 47, further comprising:

forming a chamber layer over said substrate;

defining side walls of at least one fluid ejection chamber about said fluid ejector, said side walls formed in said chamber layer;

creating a nozzle layer over said chamber layer wherein said nozzle layer includes at least one orifice.

50. The method in accordance with claim 49, wherein creating said nozzle layer further comprises creating a micromolded nozzle layer having said at least one orifice.

51. The method in accordance with claim 49, wherein forming said chamber layer further comprises forming a micromolded chamber layer having said sidewalls of said at least one fluid ejection chamber.

52. The method in accordance with claim 47, further comprising forming a photodetector on said substrate.

53. The method in accordance with claim 47, further comprising:

forming at least one fluid inlet channel in said substrate fluidically coupled to said fluid ejector; and forming a fluid distribution channel fluidically coupled to said at least one fluid inlet channel.

54. The method in accordance with claim 46, further comprising creating at least one optical triggering circuit electrically coupled to said fluid ejector and to said photodetector.

55. The method in accordance with claim 54, wherein creating said at least one optical triggering circuit further comprises:

creating a memory device electrically coupled to said photodetector; and creating a voltage level shifter electrically coupled to said memory device and to said fluid ejector.

56. The method in accordance with claim 46, further comprising mounting a focusing element between said photodetector and said photon source.

57. The method in accordance with claim 56, further comprising forming said focusing element.

58. The method in accordance with claim 46, further comprising mounting a photon beam deviator between said photodetector and said photon source.

59. The method in accordance with claim 58, further comprising forming said photon beam deviator.

60. The method in accordance with claim 46, wherein said creating a fluid ejector further comprises creating an m×n array of fluid ejectors; wherein electrically coupling said photodetector further comprises electrically coupling an m×n array of photodetectors to said m×n array of fluid ejectors; and wherein photonically coupling said electroluminescent photon source, further comprises photonically coupling an m×n array of electroluminescent photon sources to said m×n array of photodetectors, wherein each electroluminescent photon source is coupled only to a particular photodetector.

61. A method of using a fluid ejector head, comprising:

activating an electroluminescent photon source to emit photons photonically coupled to a photodetector;

photo-generating a fluid ejector activation signal in said photodetector;

electrically-coupling said activation signal to a fluid ejector; and activating said fluid ejector to eject a fluid.

62. The method in accordance with the method of claim 61, wherein activating said fluid ejector further comprises activating an energy converting element to eject essentially a drop of said fluid.

63. The method in accordance with the method of claim 62, wherein activating said energy converting element further comprises ejecting essentially a drop of said fluid having a volume in a range of from about 5 femto-liters to about 750 pico-liters.

64. The method in accordance with the method of claim 62, wherein activating said energy converting element further comprises activating a thermal resistor, wherein said thermal resistor heats a component in said fluid above said components boiling point causing vaporization of said fluid component generating an expanding bubble ejecting essentially a drop of said fluid.

65. The method in accordance with the method of claim 61, wherein photo-generating said fluid ejector activation signal further comprises amplifying a photodetector signal.

66. The method in accordance with the method of claim 65, wherein amplifying said photodetector signal further comprises shifting a voltage level of said photodetector signal.

67. The method in accordance with the method of claim 61, wherein activating said fluid ejector further comprises activating said fluid ejector to eject a fluid having a dissolved or dispersed solid in at least one component of said fluid.

68. The method in accordance with the method of claim 61, wherein activating photon source further comprises selectively activating an m×n array of photon sources; wherein photo-generating said fluid ejector activation signal further comprises selectively generating an m×n array of fluid ejector activation signals; and wherein activating said fluid ejector further comprises selectively activating an m×n array of fluid ejectors.

* * * * *